US005277859A

United States Patent [19]

Slack et al.

[11] Patent Number: 5,277,859

[45] Date of Patent: Jan. 11, 1994

[54] METHOD FOR THE PRODUCTION OF POLYPROPYLENE YARN

[75] Inventors: Ian D. Slack, Drighlington; Simon P. Slack, Gomersal, both of England

[73] Assignee: Extrusion Systems Limited, Bradford, England

[21] Appl. No.: 718,262

[22] Filed: Jun. 20, 1991

[30] Foreign Application Priority Data

Jun. 23, 1990 [GB] United Kingdom ..... 9014025

[51] Int. Cl.[5] ..... D01D 7/00; D02J 1/22; D02J 13/00

[52] U.S. Cl. ..... 264/210.8; 264/211.12; 264/235.6

[58] Field of Search ..... 264/210.8, 211.12, 235.6

[56] References Cited

U.S. PATENT DOCUMENTS 3,106,442 10/1963 Compostella et al. ..... 264/235.6

4,911,165 3/1990 Lennard et al. ..... 264/210.8 X

*Primary Examiner*—Leo B. Tentoni

*Attorney, Agent, or Firm*—Staas & Halsey

[57] ABSTRACT

A process and apparatus for producing multi filament yarn from polypropylene polymer. The process includes the steps of spinning an undrawn yarn using a spinnerette, and winding the undrawn yarn on a bobbin. Subsequently the undrawn yarn is unwound so that no twist is imparted to the yarn and the yarn is then drawn between godet rollers through a convection oven, the drawn yarn being wound on a bobbin.

16 Claims, 1 Drawing Sheet

METHOD FOR THE PRODUCTION OF POLYPROPYLENE YARN

BACKGROUND OF THE INVENTION

The present invention relates to a method and apparatus for the production of polypropylene yarn.

1. Field of the Invention

2. Description of the Related Art

Fibers or filaments made from polypropylene have been available from the early 1960's when the resin first became commercially available. The first polypropylene filament yarn was produced on conventional melt spinning equipment used for the production of nylon and polyester yarns. Initially a two-stage process was employed where the polypropylene was melt spun through a spinnerette, cooled in a stream of air, and then wound onto bobbins in the undrawn state. This undrawn yarn was then processed on a draw twister machine where it was stretched between heated godet rollers and then immediately twisted up on a ring twisting spindle. On such a machine the final yarn speed would be in the order of 50–100 meters per minute.

Polypropylene yarn produced by this method displayed medium to good strength with low elongation which made it suitable for some industrial applications. The main problem with the commercial development of this method of manufacture was due to the extremely high cost of draw twisting machines, plus a labor intensive operation with very low output.

A modified version of the Draw-Twister, known as a Draw-Winder, where the ring twisting spindle is replaced by a high speed winding unit, enables a considerable increase in operating speed. Although the increase in speed offsets the capital cost and labor intensity, the yarn produced at higher speed showed a considerable reduction in strength, with corresponding higher elongation. Polypropylene yarn with these characteristics is perfectly acceptable for domestic textile applications but it is unsatisfactory for industrial use where strength is a prime requirement.

During the 1960's, a new development was taking place in the synthetic fiber industry and a new process evolved known as the "Spin-Draw-Wind" process. In this process the yarn is melt spun through a spinnerette, cooled in a stream of air, and then immediately stretched between heated godet rolls and finally wound up on on a high speed winding machine. In this process yarn speeds of 3000 meters per minute or more can be achieved. However, polypropylene yarn produced on this system has a relatively low strength and high elongation. These properties are again acceptable for many domestic textile applications but are of no use for industrial applications where strength is a prime requirement.

During the 1970's a new process was specially developed for processing polypropylene. This is known as the "Short Spin" process. In this process a large volume of cooling air is blown at relatively high velocity, typically 10 meters per second, across the face of the spinnerette onto the molten filaments as they emerge. The filaments are rapidly cooled and solidify within a few centimeters of the face of the spinnerette. These filaments are then stretched in hot air or in a steam chest between a series of godet rollers.

The Short Spin method was primarily developed for the production of staple fiber for use in carpets and floor coverings, and as such, requires very low strength and high elongation.

A development of the Short Spin process was to produce continuous filament yarn by replacing the staple cutting equipment at the end of the production line, with suitable winders. By carefully adjusting the processing conditions it is possible by this method to produce yarns with medium to good strength, but the adjustment is extremely critical and a considerable variation in physical properties can be experienced even between yarns produced under identical conditions on the same machine. Variation of strength also occurs along the length of a single yarn. Such uncontrollable variation makes yarn produced by the Short Spin process unacceptable for critical industrial applications.

For the Short Spin process to work, the polymer used must have high melt strength to withstand the force of the cooling air blowing on the molten filaments at the face of the spinnerette. Polymers which display high melt strength are those which have a wide molecular weight distribution. It is because of the variation in molecular weight distribution that the resultant fibers display an unacceptable variation of physical properties.

To produce a polypropylene yarn with consistent physical properties, it is necessary to use a polymer with a narrow molecular weight distribution. These polymers are produced by controlling the rheology during the polymerization process. However the effect of this is that such polymer has a relatively low melt strength making it at best difficult, and generally impossible to use on the Short Spin process.

In view of the foregoing, it is obvious that there was no satisfactory viable process for the production of consistently high quality, high strength polypropylene yarns for use in industrial applications. It was for this reason that some 30 years after polypropylene had become commercially available, only a minute quantity had found acceptance in industrial applications, in spite of polypropylene's other properties such as immunity to attack by most solvents, and chemicals in general.

It is well-known that the tensile strength of a filament yarn is directly related to the degree of molecular orientation in the fiber. It is further known that the total amount of molecular orientation is the sum of the orientation that is imparted during the melt spinning phase, i.e. as the polymer flows through the holes in the spinnerette, and as it is drawn away from the face of the spinnerette under tension prior to the polymer changing from the molten state to the solid state, plus the orientation imparted during the final drawing stage.

It is also well known that by utilizing known processes very slowly, high tenacity yarns can be produced but at such a rate as to be totally unviable in a commercial sense.

SUMMARY OF THE INVENTION

The aim of the present invention is to provide a commercial manufacturing process and apparatus to produce polypropylene yarn with consistently high tensile strength.

According to the present invention there is provided a process for producing multi-filament yarn from polypropylene polymer including the steps of spinning and winding an undrawn yarn, subsequently unwinding the yarn so that no twist is imparted to the yarn, and drawing the yarn whilst applying heat to the yarn as it is being drawn.

During the development of the present invention it was found that the "time factor" had a substantial effect both during the process of melt spinning as well as during the process of stretching or drawing. This factor had not been apparent on previous types of melt spinning equipment because of the relative fixed position of spinnerettes, air quench systems, godet rollers, etc. which meant that as the process was speeded up, the time for cooling or stretching was proportionally reduced.

For instance, it was found that if the cooling of the filaments issuing from a spinnerette face was effected over a distance of 2.5 meters instead of 0.5 meters as used in the Short Spin method, and the cooling air was reduced in velocity from 10 meters per second to 1.0 or less meters per second, it was found that it was possible to spin polymers with a narrow molecular weight distribution. Furthermore the yarn could be produced with a spinning speed of 600 meters a minute which retains the potential to be subjected to a high draw ratio during stretching—hence capable of producing a final yarn with a high tensile strength and low elongation.

Yarn produced by the above method was drawn on a standard Draw-Twister as used for nylon and polyester. However, it was found that if the yarn was drawn slowly at around 50 meters a minute final speed, very consistent, high tensile strength yarns could be produced but as the speed was increased, a marked fall off in tensile strength was noted, and in fact yarn breakages occurred. A "time constant" was involved. In other words a certain time was required to allow the molecular structure to align itself under tension, and if the time permitted for this to take place was insufficient, the molecular chains were broken or torn, resulting in yarn of low strength.

To overcome this orientation problem, a Draw Twister was modified so that the godet rolls were moved wider apart so that the yarn, whilst under tension, had an increased time for the molecules to be aligned. This process was tested out using undrawn yarn produced over a long cooling distance as above, but disappointingly it was found that the yarn stretched with the godet rollers wider apart, showed a decrease in tensile strength. It was found that although a longer time was available for the orientation process to occur, it was occurring whilst the filaments were rapidly cooling, as they were being stretched in ambient air. In addition to the time factor, application of heat to maintain the temperature of the fibers during the stretching process was thus found to be essential.

To perform the method of the present invention a new stretching device was constructed with a pair of godet rollers. One roller was provided for feeding the yarn at a constant speed and another roller was provided for drawing the yarn away at an increased speed to provide the drawing force, the rollers being placed approximately 4 meters apart. Between the two godet rollers, a hot air convection oven was placed so that hot air was blowing on the yarn immediately after the yarn entered the oven and continued to blow hot air on the yarn until it passed onto the second higher speed godet roller. It was found that utilizing this method a consistently high draw ratio could be imparted to the yarn and furthermore the speed of operation could be increased up to 200 meters per minute. Under these conditions, polypropylene yarn can be produced with consistently high tensile strength.

It was, however, noted that the yarn produced by the above method had a regular cyclic, weaker spot, which coincided with an area of twist in the yarn. It was noted that this twist had emanated from the fact that the undrawn yarn was being fed into the process by the conventional method of taking it from the package overend so that for every wrap of yarn unwound, a single twist was imparted into the yarn. By repeating the experiment, but in this case arranging it so that the undrawn yarn from the supply package was removed by unrolling it so that no twist was imparted, the strength of the final yarn improved and the cyclic variation problem disappeared.

Further improvements can be made by precisely controlling the temperature and velocity of the cooling air in the first stage of the process (melt spinning of undrawn yarns) and the temperature and velocity of the hot air in the convection oven during the second stage stretching operation. By optimizing all these conditions, it has been possible to provide a viable commercial process for the production of high tensile polypropylene yarns with physical properties even superior to those displayed by commercially available high tenacity nylon and polyester yarns which are currently used in industrial applications.

It was further found that yarn produced by the method of the present invention could be stabilized to minimize heat shrinkage by passing the yarn between an identical set of godet rollers through a convection oven as used for the orientation. This stabilization was achieved by running the godet rollers at the same speed so that neither shrinkage nor extension of the yarn occurs. By this method of stabilization, only an insignificant loss of tensile strength and increase in elongation occurs.

The present invention can thus produce a high tenacity polypropylene yarn i.e. a yarn with a tensile strength equal to or greater than 7.5 gms per denier, on a viable commercial basis.

The present invention will now be further described, by way of example, with reference to the accompanying drawings, in which:

DESCRIPTION OF THE PREFERRED EMBODIMENTS

Figure 1:
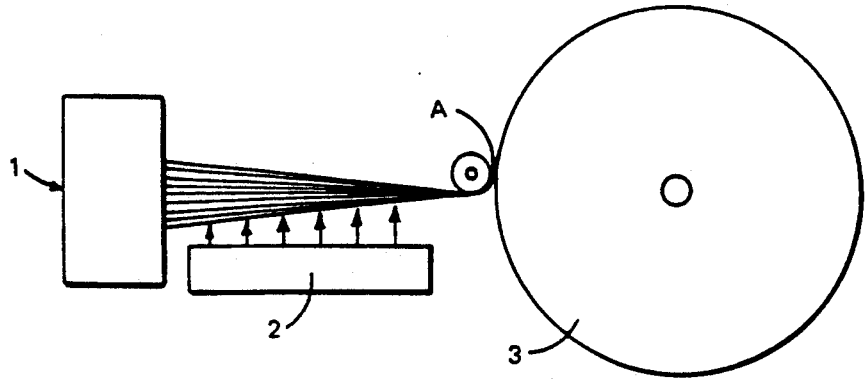
FIG. 1 is a schematic representation of apparatus suitable for use in the first stage of an the present invention to produce undrawn polypropylene yarn.

An apparatus suitable for use in the present invention is schematically illustrated in the accompanying drawings. The apparatus of FIG. 1 includes a spinnerette 1 for producing fibers of polypropylene, the polypropylene polymer preferably having a narrow molecular weight distribution. These fibers are cooled by a stream of cooling air which is directed from a cooling air supply means 2 generally at right angles to and along the length of the fibers. The fibers converge at the end of the cooling zone which is defined by the length of said supply means 2, and are spun to form a yarn A which is wound onto a bobbin 3 in an untwisted manner.

Figure 2:
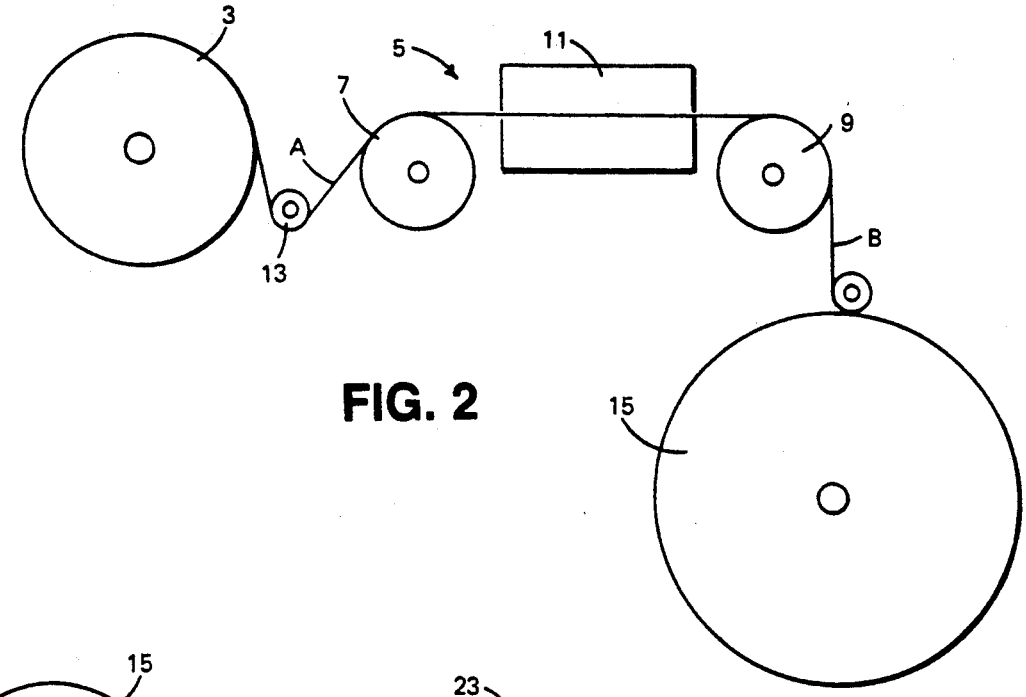
FIG. 2 is a schematic representation of a further apparatus for use on the present invention.

The temperature and velocity of the cooling air is precisely controlled to thus produce a yarn A from a polymer with a narrow molecular weight distribution, which yarn A retains the potential to be subjected to a high draw ratio during stretching in the apparatus of FIG. 2, and is thus capable of producing a final yarn B with a high tensile strength and low elongation.

The bobbin 3 of yarn A is subsequently used in the stretching apparatus 5 of FIG. 2, this stretching apparatus 5 including a pair of godet rollers 7 and 9 approximately 4 meters apart with a convection oven 11 extending between the godet rollers 7,9.

The yarn A is thus fed from the bobbin 3 around a guide roller 13, around the first godet roller 7, through the convection oven 11, around the second godet roller 9, and then the stretched yarn B is collected on a further bobbin 15. The stretching is performed by the second godet roller 9 rotating at a faster speed than the first godet roller 7, the stretching being completed in the heated atmosphere within the convection oven 11. By precisely controlling the temperature and velocity of the hot air in the convection oven 11 as well as the temperature and velocity of the cooling air in the first melt spinning stage, and by optimizing these conditions, it has been possible to produce a viable commercial process for the production of high tensile polypropylene yarns.

Figure 3:
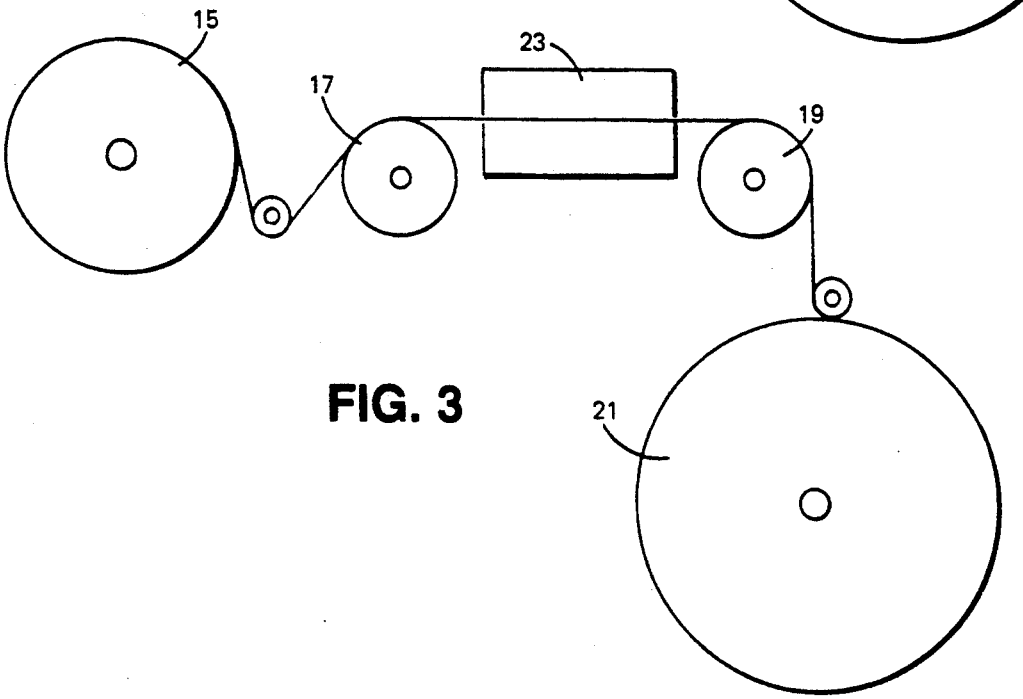
FIG. 3 is a schematic representation of still a further apparatus for use in the present invention.

The yarn B produced by the process and apparatus described hereabove can be stabilized to minimize heat shrinkage, by passing the yarn B through further apparatus shown in FIG. 3, which apparatus is identical to the apparatus of FIG. 2, the godet rollers 17,19 of this further apparatus being run at the same speed so that neither shrinkage nor extension of the yarn occurs, the resultant yarn being collected on bobbin 21. By this method of stabilization only an insignificant loss of tensile strength and increase in elongation occurs. Alternatively godet rollers 17,19 can be run at slightly different speeds. For example, godet roller 19 can be run at a slower speed than godet roller 17 to allow for retraction of the yarn in the oven 23.

During trials using the method and apparatus of the present invention a narrow molecular weight distribution polypropylene polymer was used with a melt flow index of 19 according to ASTM-D1238, and a density of 0.903 gms/cc according to ASTM-D792.

In the first spinning trial the above polymer was melted in an extruder at 210° C. and extruded through a spinnerette with 148 orifices. The fibers so produced were cooled in an air duct 2.5 m long with an air velocity of 0.6 meters per second and a temperature of 18° C. The updrawn yarn A was wound up at 300 meters/minute.

The yarn A so produced was subsequently stretched between a set of godet rollers placed 4 meters apart. The speed of the first godet roller was 20 meters/minute and the speed of the second godet roller was 160 meters/minute. The hot air convection oven was 3.5 meters long with an air temperature of 150° C. and an air velocity of 10 meters per second. The resultant yarn B of 1000 total denier had a minimum tenacity of 8.3 gms per denier.

The stretching trail was repeated with godet roller speeds being 25 meters per minute and 200 meters/minute respectively, all other conditions remaining unchanged. The resulting yarn of 1000 total denier had a minimum tenacity of 7.6 gms per denier.

In a second spinning trail the undrawn yarn was wound up at a speed of 600 meters/minute, all other parameters remaining as above. This yarn was stretched with godet roller speeds of 25 meters/minute and 150 meters/minute respectively with all other parameters remaining the same as above. The resultant yarn had a total denier of 500 with a tenacity of 9.6 gms per denier.

The present invention provides a simple method and apparatus for commercially producing high tenacity polypropylene multi-filament yarn.

We claim:

1. A process for producing multi-filament yarn from polypropylene polymer, comprising the steps of:
spinning and winding an undrawn yarn;
after completion of said spinning and winding of the undrawn yarn, unwinding the yarn so that no twist is imparted to the yarn; and
drawing the yarn whilst applying heat to the yarn as it is being drawn.

2. A process according to claim 1, wherein the undrawn yarn is cooled over a distance of at least 2.5 meters prior to winding, by a stream of air flowing, substantially at right angles to the filament path.

3. A process according to claim 1, wherein the undrawn yarn is spun at a speed of up to 600 meters per minute.

4. A process according to claim 1, wherein the undrawn yarn is drawn over a distance of approximately 4 meters.

5. A process according to claim 1, wherein the undrawn yarn is drawn over a distance of approximately 4 meters at a speed of up to 200 meters per minute.

6. A process according to claim 1, wherein the drawn yarn is subsequently passed through a heated region to further stabilize the yarn.

7. A process as recited in claim 2, wherein the air flows at a rate of 0.6 to 1 meters per second.

8. A process for producing multi-filament yarn from polypropylene polymer, comprising the steps of:
spinning and winding an undrawn yarn,
wherein the undrawn yarn is cooled by a stream of air flowing at 0.6 to 1 meters per second, substantially at right angles to the filament path,
after completion of said spinning and winding of the undrawn yarn, unwinding the yarn so that no twist is imparted to the yarn; and
drawing the yarn whilst applying heat to the yarn as it is being drawn.

9. A process according to claim 7, wherein the undrawn yarn is spun at a speed of up to 600 meters per minute.

10. A process according to claim 7, wherein the undrawn yarn is drawn over a distance of approximately 4 meters.

11. A process according to claim 7, wherein the undrawn yarn is drawn over a distance of approximately 4 meters at a speed of up to 200 meters per minute.

12. A process according to claim 7, wherein the drawn yarn is subsequently passed through a heated region to further stabilize the yarn.

13. A process according to claim 8, wherein the undrawn yarn is spun at a speed of up to 600 meters per minute.

14. A process according to claim 8, wherein the undrawn yarn is drawn over a distance of approximately 4 meters.

15. A process according to claim 8, wherein the undrawn yarn is drawn over a distance of approximately 4 meters at a speed of up to 200 meters per minute.

16. A process according to claim 8, wherein the drawn yarn is subsequently passed through a heated region to further stabilize the yarn.

* * * * *